US007628384B2

(12) United States Patent
Smith

(10) Patent No.: US 7,628,384 B2
(45) Date of Patent: Dec. 8, 2009

(54) RATCHET BLOCK

(75) Inventor: Giles Smith, Burnham-on-Crouch (GB)

(73) Assignee: Allen Brothers (Fittings) Limited (GB)

( * ) Notice: Subject to any disclaimer, the term of this patent is extended or adjusted under 35 U.S.C. 154(b) by 0 days.

(21) Appl. No.: 12/283,201

(22) Filed: Sep. 10, 2008

(65) Prior Publication Data

US 2009/0072209 A1 Mar. 19, 2009

(30) Foreign Application Priority Data

Sep. 13, 2007 (GB) ..... 0717855.1

(51) Int. Cl.
*B66D 3/04* (2006.01)

(52) U.S. Cl. ..... 254/413; 254/416

(58) Field of Classification Search ..... 254/391, 254/392, 413, 414, 416
See application file for complete search history.

(56) References Cited

U.S. PATENT DOCUMENTS

| | | | | |
|---|---|---|---|---|
| 328,340 | A * | 10/1885 | Robbins | 254/416 |
| 2,349,084 | A * | 5/1944 | Findley | 384/447 |
| 2,356,147 | A * | 8/1944 | Caldwell | 294/82.12 |
| 7,431,269 | B2 * | 10/2008 | Carlson et al. | 254/405 |

FOREIGN PATENT DOCUMENTS

| | | |
|---|---|---|
| GB | 2287688 | 9/1995 |

* cited by examiner

*Primary Examiner*—Emmanuel M Marcelo
(74) *Attorney, Agent, or Firm*—Renner, Kenner, Greive, Bobak, Taylor & Weber

(57) ABSTRACT

The present invention provides a ratchet block with a block body 10 having a pair of side cheeks 11,12 and a sheave assembly 15 therebetween, which comprises a hub 16 supporting an annular sheave 17 for rotation about a principal axis. The ratchet block also includes a ratchet mechanism comprising ratchet teeth 19 on the sheave and a pawl 20 mounted on the hub 16 or a side cheek 11,12 for movement between an engaged setting, where the ratchet mechanism is active, and a free setting where the ratchet mechanism allows free rotation of the sheave. An actuator 25 is also mounted on the hub 16 or said side cheek 11,12 and linked to the pawl 20 to effect movement thereof between its engaged and free settings. Means are provided for pivoting the hub between loaded and unloaded limiting positions about an axis parallel to but spaced from the hub's principal axis. Spring means 33 are provided for biasing the hub 16 to said unloaded limiting position. There are also included means 38 for interconnecting the actuator 25 and the other of the hub 16 and said side cheeks 11,12. Pivoting movement of the hub from its unloaded position against the action of the spring means 33 under an applied load on the sheave 17 causes the actuator to effect movement of the pawl 20 to its engaged setting.

22 Claims, 8 Drawing Sheets

RATCHET BLOCK

This invention relates to a ratchet block, and in particular to a ratchet block where the operation of the ratchet depends upon the load to which the block is subjected by a line passing around a sheave rotatably mounted within the block.

Ratchet blocks for use in yachting, dinghy sailing and the like are well known and typically comprise a block body defining a pair of cheeks, between which is rotatably mounted a sheave. A ratchet mechanism is mounted on the block body and cooperates with ratchet teeth formed on the sheave such that when the mechanism is active, the sheave may rotate in only one sense. Generally, a manually-operable control for the ratchet mechanism is provided, whereby the mechanism may be switched between active and inactive settings, and when inactive, the sheave may rotate in either sense.

Particularly when racing sailing boats of various kinds, the control lines for the sails may be subjected to relatively high loads. If that line passes around a block attached to some other component, a correspondingly high load will be imparted to the block. If the bitter end is being held manually, the load on the line may be relieved by employing a ratchet block arranged so that when the ratchet is active, the line may be pulled in but the ratchet mechanism resists rotation of the sheave in the direction which allows the line to be payed out.

If the ratchet mechanism is set to its active position and the line is to be payed out, the ratchet mechanism will resist free rotation of the sheave and so the line will not run smoothly through the block. As such, it may be necessary to switch the mechanism so as to be in its inactive setting, when the line is to run free.

In order to overcome this disadvantage of having to switch the ratchet mechanism between its active and inactive settings depending upon whether a line is to be hauled in or payed out, it is known to provide a block with an automatically operating ratchet mechanism, the operation of which depends upon the load to which the block is subjected. There have been various proposals for such blocks and it is a principal aim of this invention to provide an improved form of a load activated ratchet block which is relatively easy to manufacture and yet which is reliable in operation. A further aim of preferred forms of the block is to allow pre-setting, either during manufacture or by a user, of the load at which the ratchet mechanism becomes active, or becomes inactive.

According to this invention, there is provided a ratchet block comprising:

- a block body having a pair of spaced side cheeks;
- a sheave assembly mounted between the cheeks and comprising a hub defining a principal axis and supporting an annular sheave for rotation about said principal axis;
- a ratchet mechanism comprising ratchet teeth provided on the sheave, a pawl mounted on one of the hub and a side cheek for movement between an engaged setting where the ratchet mechanism is active and a free setting where the ratchet mechanism allows free rotation of the sheave, and an actuator also mounted on said one of the hub and said side cheek and linked to the pawl to effect movement thereof between its engaged and free settings;
- means pivoting the hub between the side cheeks about an axis parallel to but spaced from the hub principal axis for pivoting movement between loaded and unloaded limiting positions;
- spring means biasing the hub to said unloaded limiting position; and
- means interconnecting the actuator and the other of the hub and said side cheek whereby pivoting movement of the hub from its unloaded position against the action of the spring means under an applied load on the sheave causes the actuator to effect movement of the pawl to its engaged setting.

Though the pawl and actuator could be mounted on a side cheek with the actuator being operated by said interconnecting means carried on the hub, the most preferred embodiment has the pawl and actuator mounted on the hub.

It will be appreciated that the operation of the ratchet mechanism with the block of this invention depends upon the load to which the block is subjected. The hub of the sheave assembly is pivoted to the block body about an axis spaced from the principal axis of the sheave assembly and that assembly is spring loaded to an unloaded limiting position. When the block body is secured to some other component and a line passing around the sheave is subjected to tension, the sheave assembly will pivot against that spring loading to its loaded position. This pivoting movement of the sheave assembly moves the actuator from its first setting which in turn moves the pawl to its engaged setting so rendering active the ratchet mechanism.

Typically, the side cheeks are held in the required disposition by a bridging piece, which may be part of the side cheeks or a separate spacer. That bridging piece conventionally serves as a mounting for the block; for example, a mounting pin could rotatably be supported in the bridging piece or a strop may pass around the bridging piece to tie the block to some other component. In order to allow operation as described above, the pivotal axis of the hub to the side cheeks preferably lies on a diameter extending substantially at right angles to a notional line passing through said principal axis of the sheave assembly and the bridging piece. If then a load is imparted to a line passing around the sheave, the block will tend to align itself with said notional line, so enabling the sheave assembly to pivot as aforesaid, when that load is sufficiently high to overcome the bias of the spring means.

In a preferred form of this invention, the pawl is pivoted to the hub for movement between ratchet-engaged and free settings. Similarly, the actuator is also mounted on the hub for pivoting movement between first and second settings, corresponding respectively to the unloaded and loaded limiting positions of the hub. In this case, the pawl may be connected to the actuator by an over-centre spring mechanism so as to have stable engaged and free settings. Such a mechanism may include a helical compression spring having one end engaged with the pawl and the other end with the actuator, whereby the movement of the actuator from either the first or second settings thereof bends the spring, initially compressing the spring until an over-centre position is reached whereafter the spring extends again, so moving the pawl to its other setting.

The hub may be generally annular and so have a central bore, with said spring means being disposed within that bore and acting between the hub and a fixed part of the block body. Conveniently, that fixed part comprises an abutment extending through the bore of the hub. The spring means may comprise a hoop-stressed C-shape spring one end of which is connected to the abutment and the other end of which is connected to the hub. Preferably, the force imparted by the spring can be adjusted either during manufacture or subsequently by a user, for example by changing the number of springs disposed within the hub, or changing a spring of one spring-rating by another having a different spring-rating.

The actuator is moved from its first position upon pivoting movement of the hub from its unloaded position against the action of the spring means, under an applied load. For this purpose, the actuator may include a cam profile co-operable with a cam follower provided on the adjacent side cheek whereby the actuator is moved from its first position where the hub is in its unloaded position to a second position as the hub is moved to its loaded position, under the action of an applied load on the sheave. Preferably, means are provided to limit the pivoting movement of the hub about its pivotal axis to the side cheeks. Conveniently, an elongate slot is provided at a location opposed to the pivoting axis of the hub and engaged by an abutment formed on the hub.

The block may include a pair of similar ratchet mechanisms each as described above, and disposed one to each side of the sheave so as to be operable in unison.

By way of example only, two specific embodiments of load-activated ratchet block arranged in accordance with this invention will now be described in detail, reference being made to the accompanying drawings in which:—

Figure 1:
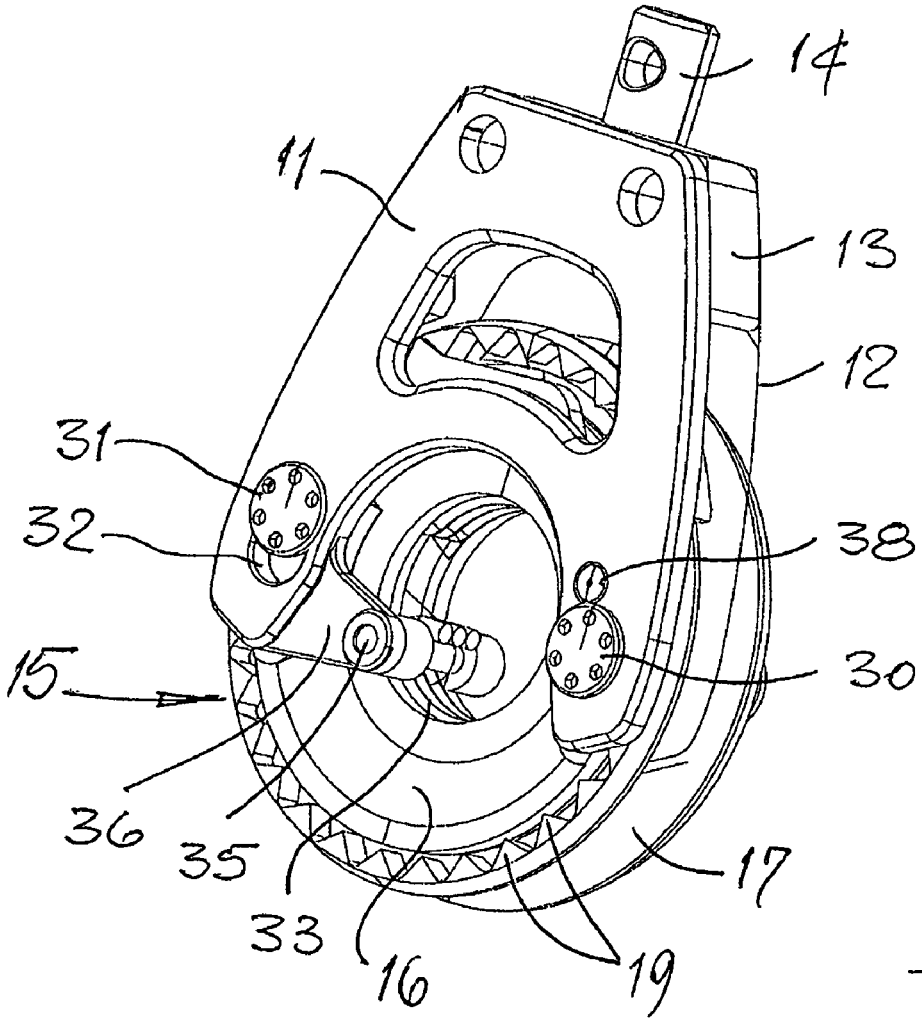
FIG. 1 is an isometric view of the first embodiment, from one side but with the opposed side cheek removed for clarity.

Referring initially to FIGS. 1 to 5 there is shown the first embodiment of load-activated ratchet block of this invention. This block comprises a block body 10 having a pair of side cheeks 11 and 12, held in the required spaced-apart disposition by a bridging piece 13. A pin 14 is rotatably mounted in the bridging piece. The side cheeks and bridging piece are clamped together by means of through bolts or rivets (not shown).

A sheave assembly 15 is mounted between the two side cheeks 11,12 and comprises a hub 16 rotatably supporting an annular sheave 17, typically by means of a pair of ball races (not shown) having balls running on tracks provided on both the hub and the sheave. The hub is formed in two parts split in a radial plane and held together by rivets 18, following the mounting of the sheave 17 thereon. Such an assembly is well known in the block art and will not be described in further detail here.

The block incorporates a load-activated ratchet mechanism in order to prevent rotation of the sheave in one sense when a line extending around the sheave applies a load to the block in excess of a predetermined value. On both sides of the annular sheave 17, adjacent the periphery thereof, is a ring of inwardly directed ratchet teeth 19. Each of those rings of teeth are engageable by a respective pawl 20, though in the following the arrangement on only one side of the sheave assembly will be described. The pawl 20 is pivoted to the hub 16 about shaft 21 extending through the hub. The profiling of the pawl 20 and teeth 19 as well as the location of the shaft 21 are such that when the pawl is spring-urged into engagement with the ratchet teeth (as will be described below), the sheave 17 may freely rotate in a clockwise direction (in FIG. 2) but rotation in the counter-clockwise direction is blocked. The pawl 20 has the form of a first order lever with one end 22 profiled for engaging the ratchet teeth 19 and the opposed end is bifurcated to define a slot 23 for receiving one end of a helical compression spring 24 (FIG. 3). The other end of the spring 24 is received in the correspondingly bifurcated end of an actuator 25, also pivoted to the hub 16, about a further shaft 26. A stop 27 is provided on the hub 16, to limit rotation of the pawl 20 in a clockwise sense (FIG. 3).

The sheave assembly 15 is pivotally mounted between the side cheeks 11 and 12 by means of a dowel 29 extending through aligned bores in the side cheeks and in the hub 16. Typically, the dowel is in two parts threaded together, each part having an enlarged head 30 for engaging the outer face of the adjacent side cheek and provided with holes to permit threading engagement of the two parts, using a suitable tool. The bore through the hub 16 extends parallel to but spaced from the rotational axis of the sheave 17 and also is displaced to one side of the axis of the mounting pin 14. Pivoting movement of the hub assembly about dowel 29 is limited by a further dowel 31 extending through a bore in the hub diametrically opposed to the bore receiving dowel 29, that further dowel extending through elongate slots 32 in the side cheeks 11 and 12. Rather than having dowels 29 and 31 extending through respective bores in the hub, a spigot may project from both sides of the hub at each location where a dowel is required. The spigot may be threaded axially with a fastener threaded thereon.

A plurality (and in this embodiment, three) of C-shaped springs 33 are located side-by-side within the bore of the hub 16. The ends of the spring are appropriately profiled so that one end of each spring is engaged with a first bar 34 located in a radially outwardly directed recess in the inner surface of the hub 16 and the other end is hooked around a second bar 35 carried in a pair of lugs 36 projecting inwardly from the two side cheeks 11 and 12. In this way, the sheave assembly 15 is spring-urged to an unloaded position shown in FIGS. 1, 2 and 3 where the further dowel 31 is in engagement with the ends of the slots 32 nearer the mounting pin 14 but the sheave assembly may be pivoted against the force of the springs 33 to a loaded position shown in FIG. 5 where the further dowel 31 is in engagement with the opposed ends of the slots 32. Such movement of the sheave assembly to its loaded position will occur in use upon a load being imparted to the block by a line (not shown) passing around the sheave, with the block being attached to a component by means of the mounting pin 14.

The arrangement of the pawl 20, actuator 25 and compression spring 24 forms an over-centre mechanism such that the pawl has two stable positions depending upon the position of the actuator 25: in one of these stable positions (FIG. 3), end 22 of the pawl is clear of the ratchet teeth and in the other of these (FIG. 5), the end 22 is spring-urged into engagement with the ratchet teeth. FIG. 4 shows an intermediate position where the axis of the spring is essentially linear and the pawl is about to move to its ratchet teeth engaging position of FIG. 5.

Figure 2:
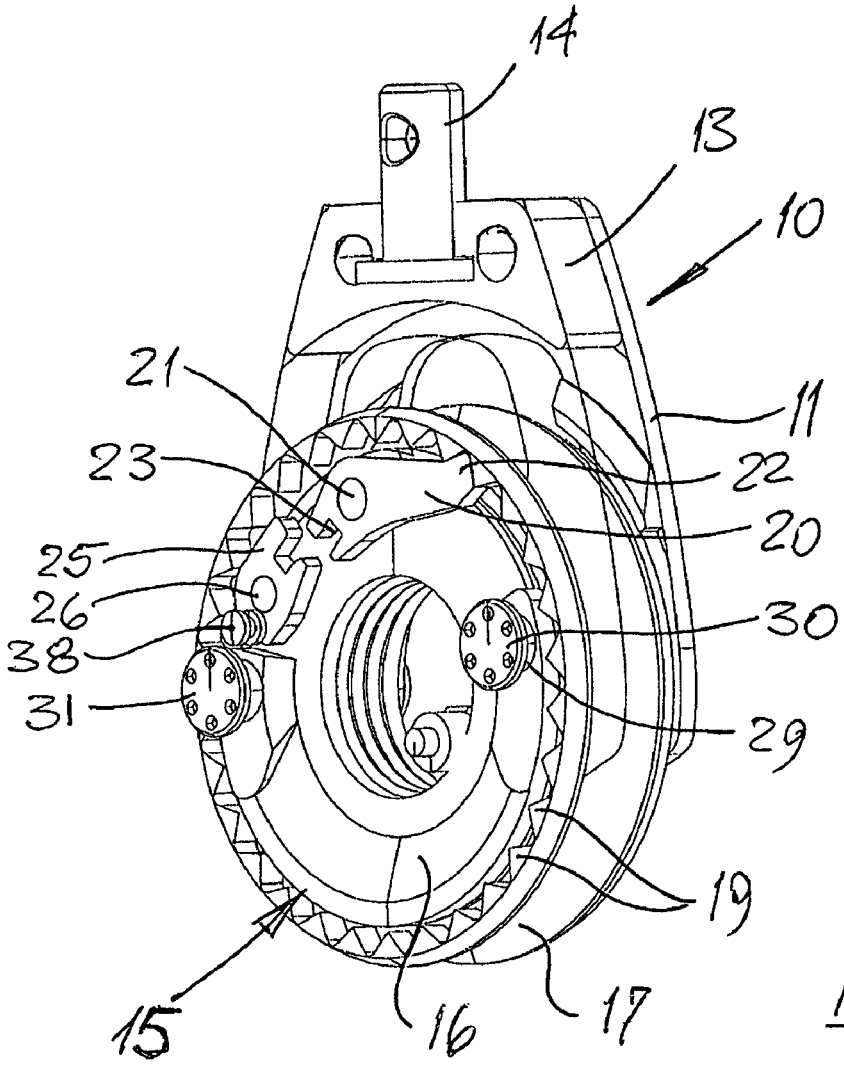
FIG. 2 is an isometric view of the block of FIG. 1, but from the other side and so with said opposed side cheek removed and also with the pawl-operating spring removed for clarity.
Figure 3:
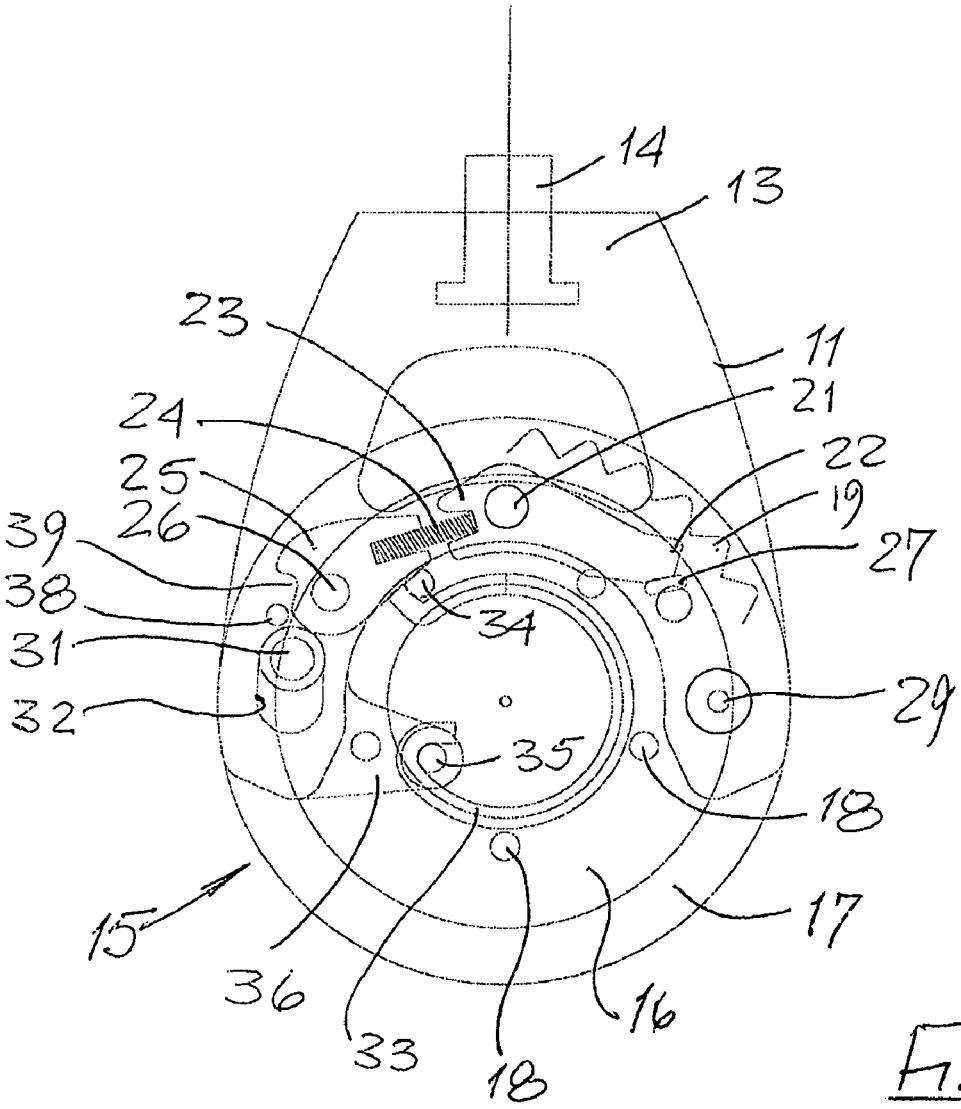
FIG. 3 is a front view of the ratchet block of FIG. 2 with the side cheek removed for clarity and with the ratchet mechanism in a starting position.
Figure 4:
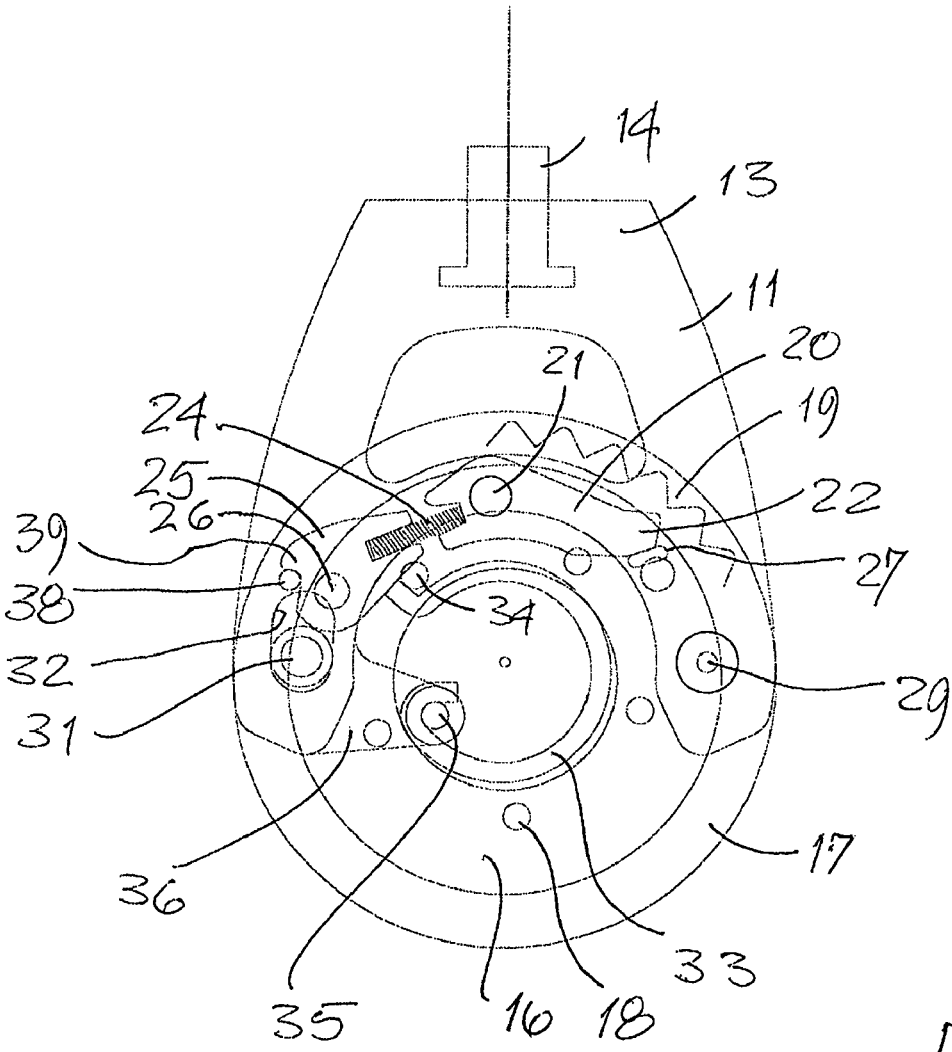
FIG. 4 is a view corresponding to that of FIG. 3 but with the block partially loaded and the ratchet mechanism in a top dead centre setting.
Figure 5:
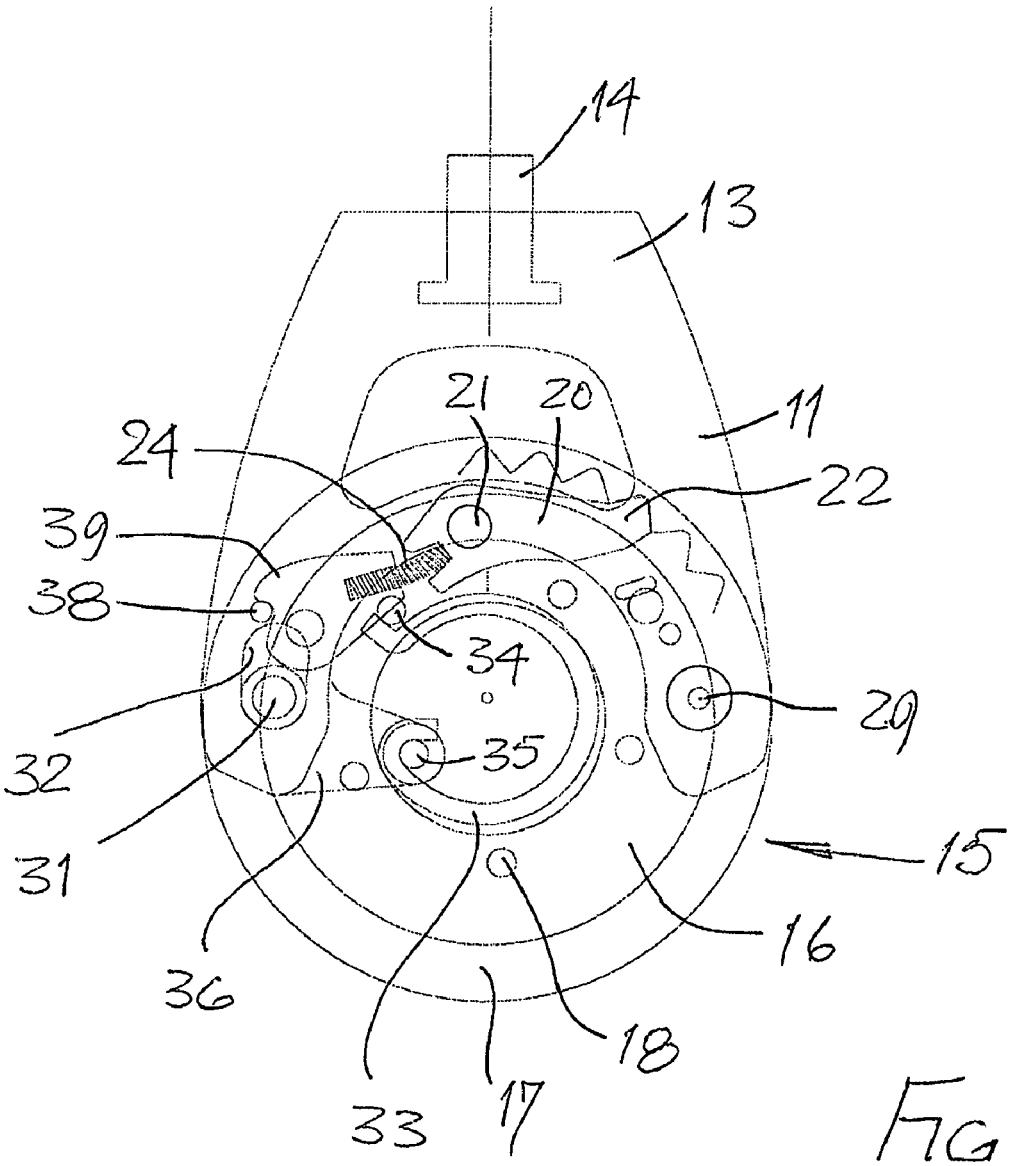
FIG. 5 is a further view corresponding to that of FIG. 3 but with the block fully loaded and the ratchet mechanism in an engaged setting.

The actuator 25 is moved from its position shown in FIGS. 2 and 3 through its position shown in FIG. 4 to its position shown in FIG. 5 upon pivoting movement of the hub assembly from its unloaded position to its loaded position. This is achieved by means of a peg 38 extending between and secured to the side cheeks 11 and 12, a cam 39 formed on the actuator 25 being engageable with that peg on movement of the sheave assembly to its loaded position. As shown in FIG. 4, the cam 39 engages the peg 38 shortly before the sheave assembly has moved fully to its loaded position and in the last stage of the movement of the sheave assembly, the actuator 25 is rotated clockwise so taking the over-centre mechanism to its other limiting position and spring-urging the pawl 20 to its position shown in FIG. 5 where the ratchet is operational. The peg 38 also serves to limit rotational movement of the actuator 25 in a clockwise direction, when the sheave assembly is in its unloaded position.

When the load is removed from a line extending around the sheave, the sheave assembly is permitted to move back to its unloaded position (FIG. 4) by the action of springs 33. The actuator 25 will remain in the position shown in FIG. 5 until the sheave is rotated in a clockwise sense. As end 22 of the pawl 20 rides over a ratchet tooth, the rotation of the pawl moves the over-centre mechanism to and through the position shown in FIG. 4 so that the actuator is returned to its initial position (FIG. 3).

The load which must be applied to the sheave assembly 15 by a line extending around the sheave in order to cause the ratchet mechanism to become active may be pre-set by controlling during manufacture the spring force of each of the springs 33, or by changing the number of springs employed within the hub 16. The latter may be made user-adjustable, by removal of the second bar 35, whereafter removal of one or more of the springs is permitted and perhaps replacement of those springs having different spring characteristics.

As mentioned hereinbefore, corresponding ratchet mechanisms are provided on both sides of the sheave assembly. These ratchet mechanisms share a common shaft 21, further shaft 26 and peg 38, with separate pawls 20, actuators 25 and compression springs 24 on each side of the hub 16. Rather than sharing a common shaft 21, further shaft 26 and peg 38, the hub could be provided with axially aligned shafts and pegs, projecting from each side of the hub.

Figure 6:
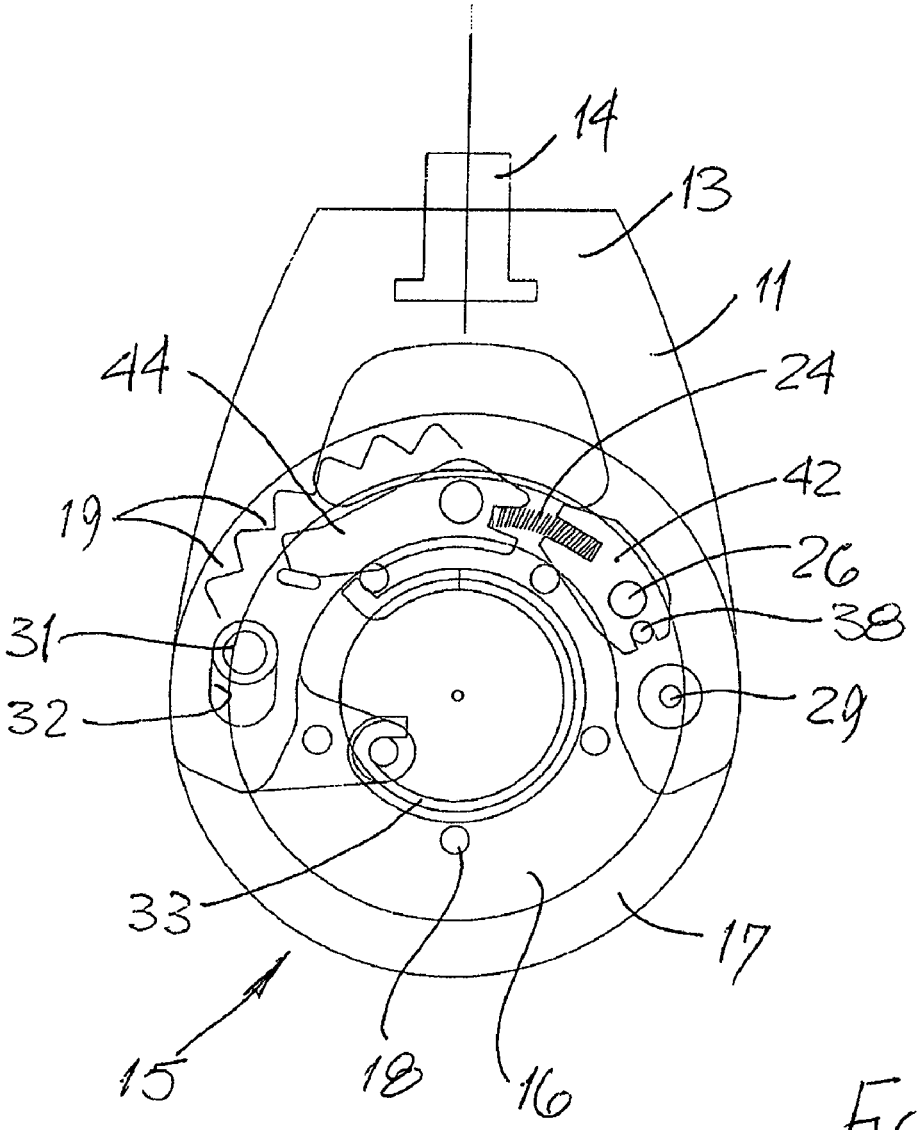
FIGS. 6, 7 and 8 correspond to FIGS. 3 to 5 but show the second embodiment of block.
Figure 7:
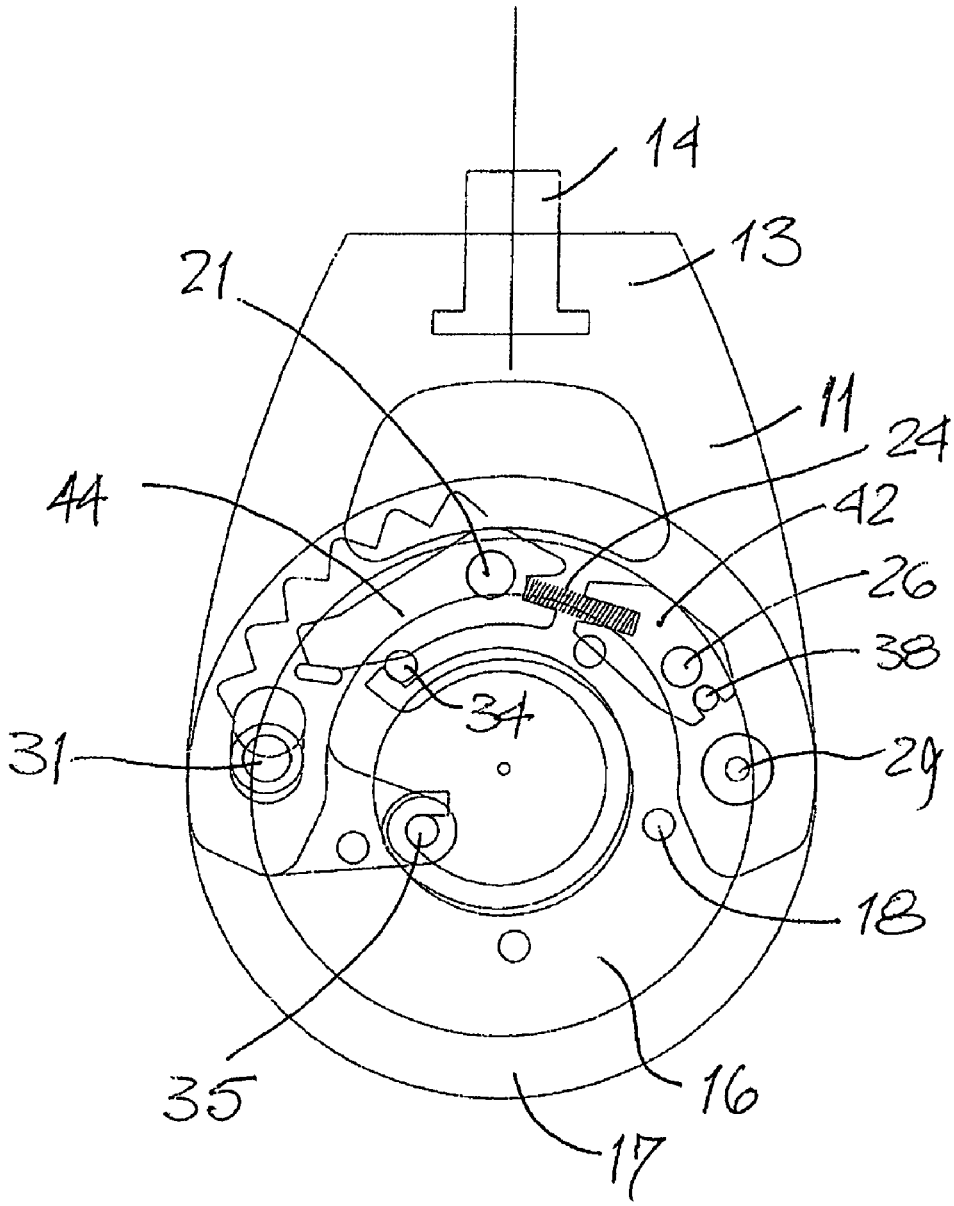
Figure 8:
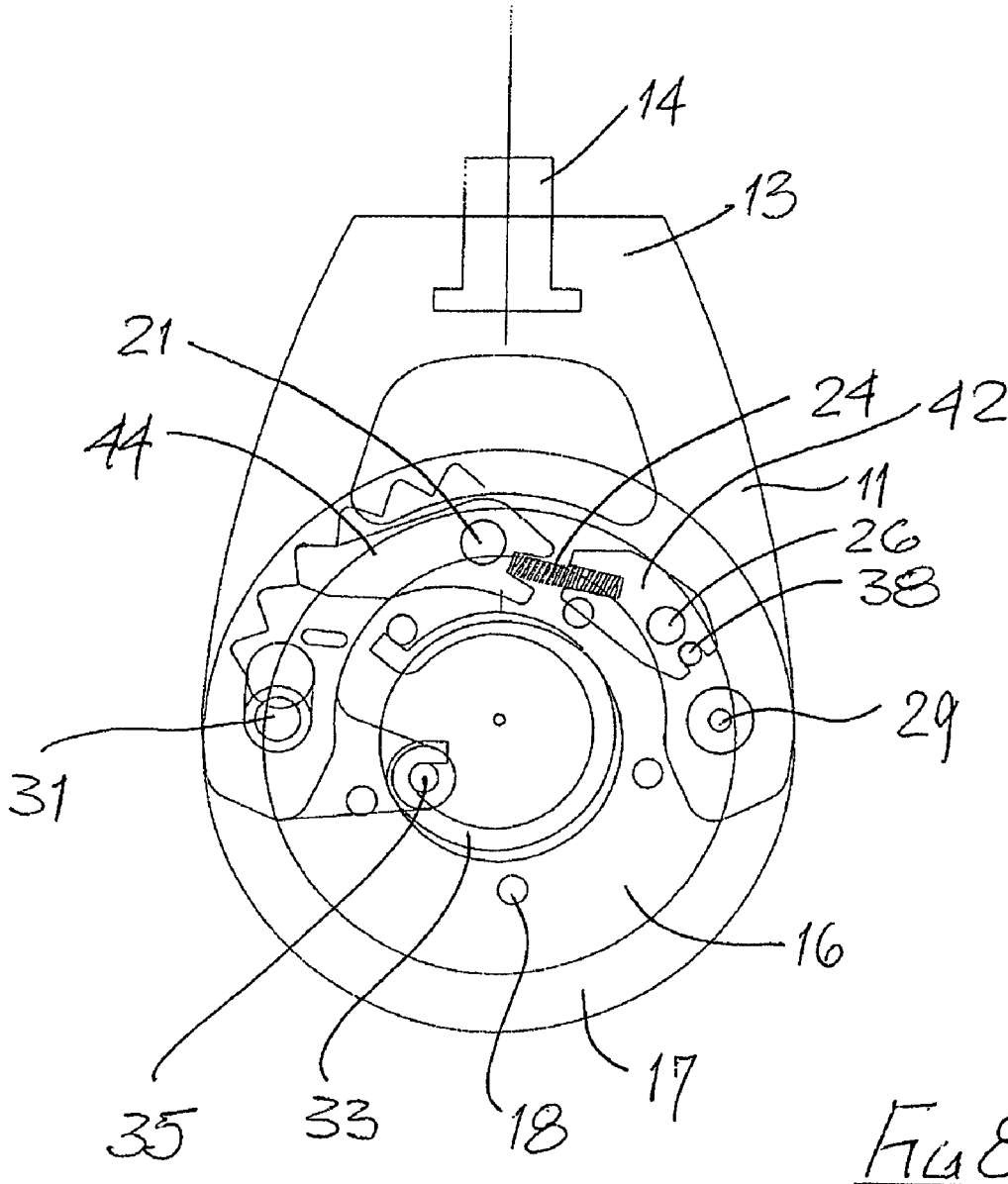

FIGS. 6, 7 and 8 show a second embodiment of load-activated ratchet block of this invention generally corresponding to that of FIGS. 1 to 5 but with the ratchet mechanism arranged slightly differently, though incorporating similar components. Like components with those of FIGS. 1 to 5 are given like reference numerals and will not be described again.

In this second embodiment, an actuator 42 is pivoted to the hub 16 about a further shaft 26 disposed close to dowel 29 and that actuator has a somewhat different cam profile as compared to actuator 25, for co-operation with peg 38 located close to dowel 29. The actuator 42 in conjunction with compression spring 24 and pawl 44 forms an over-centre mechanism, pawl 44 having a slightly different profile as compared to pawl 20 but pawl 44 has the same functionality. Also as with the first embodiment, corresponding ratchet mechanisms are provided on both sides of the sheave assembly.

As can be seen in the drawings, the peg 38 locates in a U-shaped slot formed in the actuator, with the peg being a relatively close fit so that movement between the hub and the adjacent side plate will cause corresponding movement of the actuator. A more open slot could provide a dwell space which would leave the ratchet operational despite some unloading of the sheave assembly and requiring the sheave to turn fractionally in the non-ratcheting direction to free the mechanism. A particular advantage of using a helical spring as described is that it can accommodate being pulled into an S-shape by the momentarily conflicting positions of the pawl and actuator, until the unloading has continued sufficiently to allow full operation.

Though the first embodiment shows an open cam profile 39 for the actuator 25, that actuator could have a profile similar to that of the actuator 42 described above with reference to FIGS. 6, 7 and 8.

This second embodiment of block operates in precisely the same manner as has been described above with reference to the first embodiment and no further description of that operation is required here.

The invention claimed is:

1. A ratchet block comprising:

a block body having a pair of spaced side cheeks;

a sheave assembly mounted between the cheeks and comprising a hub defining a principal axis and supporting an annular sheave for rotation about said principal axis;

a ratchet mechanism comprising ratchet teeth provided on the sheave, a pawl mounted on one of the hub and a side cheek for movement between an engaged setting where the ratchet mechanism is active and a free setting where the ratchet mechanism allows free rotation of the sheave, and an actuator also mounted on said one of the hub and said side cheek and linked to the pawl to effect movement thereof between its engaged and free settings;

means pivoting the hub between the side cheeks about an axis parallel to but spaced from the hub principal axis for pivoting movement between loaded and unloaded limiting positions;

spring means biasing the hub to said unloaded limiting position; and means interconnecting the actuator and the other of the hub and said side cheek whereby pivoting movement of the hub from its unloaded position against the action of the spring means under an applied load on the sheave causes the actuator to effect movement of the pawl to its engaged setting.

2. A ratchet block as claimed in claim 1, wherein the pawl and actuator are both mounted on the hub.

3. A ratchet block as claimed in claim 2, wherein the actuator is mounted on the hub for pivoting movement between first and second settings corresponding respectively to the unloaded and loaded limiting positions of the hub.

4. A ratchet block as claimed in claim 2, wherein the pawl is mounted on the hub for pivoting movement between said engaged and free settings.

5. A ratchet block as claimed in claim 4, wherein the actuator is mounted on the hub for pivoting movement between first and second settings corresponding respectively to the unloaded and loaded limiting positions of the hub.

6. A ratchet block as claimed in claim 5, wherein the pawl is connected to the actuator by an over-centre spring mechanism.

7. A ratchet block as claimed in claim 6, wherein the over-centre spring mechanism includes a helical compression spring having a one end and an other end, and acting between the pawl and the actuator.

8. A ratchet block as claimed in claim 7, wherein the actuator comprises a first order lever one end of which is adapted for co-operation with the adjacent side cheek and the other end of which co-operates with the said other end of the compression spring.

9. A ratchet block as claimed in claim 7, wherein the pawl comprises a first order lever one end of which is adapted for engagement with the ratchet teeth and the other end of which co-operates with said one end of the compression spring.

10. A ratchet block as claimed in claim 9, wherein the actuator comprises a first order lever one end of which is adapted for co-operation with the adjacent side cheek and the other end of which co-operates with the said other end of the compression spring.

11. A ratchet block as claimed in claim 10, wherein pivoting movement of the actuator from its first position under the action of an applied load to the hub bends the spring along its length thereby imparting a pivoting force on the pawl to render the ratchet mechanism active.

12. A ratchet block as claimed in claim 1, wherein the hub has a central bore, said spring means being disposed within that bore and acting between the hub and a fixed part of the block body.

13. A ratchet block as claimed in claim 12, wherein said fixed part of the block body comprises an abutment extending through the bore of the hub.

14. A ratchet block as claimed in claim 13, wherein the spring means comprises a hoop-stressed C-shaped spring one end of which is connected to said abutment and the other end of which is connected to the hub.

15. A ratchet block as claimed in claim 13, wherein the abutment comprises a bar mounted on a pair of lugs projecting one from each side cheek respectively such that the bar extends through the bore of the hub, the spring means being connected to the bar.

16. A ratchet block as claimed in claim 15, wherein the spring means comprises a hoop-stressed C-shaped spring one end of which is connected to said abutment and the other end of which is connected to the hub.

17. A ratchet block as claimed in claim 16, wherein a plurality of similar C-shaped springs are provided side by side within the bore of the hub, the number of such springs being selected to allow pre-setting of the load at which the ratchet mechanism operates.

18. A ratchet block as claimed in claim 1, wherein the actuator includes a cam profile co-operable with a cam follower provided on the adjacent side cheek whereby the actuator is moved from its first position where the hub is in its unloaded position to a second position as the hub is moved to its loaded position under the action of an applied load on the sheave, said movement of the actuator operating the over-centre spring mechanism.

19. A ratchet block as claimed in claimed 18, wherein the cam follower comprises a peg projecting inwardly of the block from the internal surface of the adjacent side cheek.

20. A ratchet block as claimed in claim 1, wherein means are provided to limit the pivoting movement of the hub about said axis.

21. A ratchet block as claimed in claim 20, wherein said means comprise an elongate slot in the side cheek at a location opposed to the pivoting axis of the hub and engaged by an abutment formed on the hub.

22. A ratchet block as claimed in claim 1, wherein the block has a pair of similar ratchet mechanisms disposed one to each side of the sheave and operable in unison.

* * * * *